US008349466B2

(12) United States Patent
Watwe et al.

(10) Patent No.: US 8,349,466 B2
(45) Date of Patent: Jan. 8, 2013

(54) COMPOSITE MATERIALS COMPRISING A HARD CERAMIC PHASE AND A CU-NI-SN ALLOY

(75) Inventors: Arunkumar Shamrao Watwe, Cleveland Heights, OH (US); Harold E. Kelley, Rogers, AR (US)

(73) Assignee: Kennametal Inc., Latrobe, PA (US)

( * ) Notice: Subject to any disclaimer, the term of this patent is extended or adjusted under 35 U.S.C. 154(b) by 822 days.

(21) Appl. No.: 11/709,558

(22) Filed: Feb. 22, 2007

(65) Prior Publication Data

US 2008/0202719 A1 Aug. 28, 2008

(51) Int. Cl.
*C22C 32/00* (2006.01)
*C22C 29/00* (2006.01)
*C22C 29/02* (2006.01)

(52) U.S. Cl. ..... 428/539.5; 428/551; 428/568

(58) Field of Classification Search ..... 428/539.5, 428/551, 552, 548, 568, 674
See application file for complete search history.

(56) References Cited

U.S. PATENT DOCUMENTS

| | | | |
|---|---|---|---|
| 3,175,260 | A | 3/1965 | Bridwell et al. |
| 3,379,503 | A | 4/1968 | McKenna |
| 3,684,497 | A | 8/1972 | Wendler et al. |
| 3,779,715 | A | 12/1973 | Wendler et al. |
| 3,790,353 | A | 2/1974 | Jackson et al. |
| 4,025,334 | A | 5/1977 | Cheney et al. |
| 4,327,156 | A | 4/1982 | Dillon et al. |
| 4,525,178 | A | 6/1985 | Hall |
| 4,604,106 | A | 8/1986 | Hall et al. |
| 4,694,918 | A | 9/1987 | Hall |
| 4,729,440 | A | 3/1988 | Hall |
| 4,834,963 | A | 5/1989 | Terry et al. |
| 4,836,307 | A | 6/1989 | Keshavan et al. |
| 4,916,869 | A | 4/1990 | Oliver |
| 4,944,774 | A | 7/1990 | Keshavan et al. |
| 5,045,092 | A | 9/1991 | Keshavan |
| 5,051,112 | A | 9/1991 | Keshavan et al. |
| 5,096,689 | A | 3/1992 | Terry et al. |
| 5,131,481 | A | 7/1992 | Smith |
| 5,166,103 | A | 11/1992 | Krstic |
| 5,250,355 | A | 10/1993 | Newman et al. |
| 5,290,507 | A | 3/1994 | Runkle |
| 5,304,342 | A | 4/1994 | Hall, Jr. et al. |
| 5,328,763 | A | 7/1994 | Terry |
| 5,370,195 | A | 12/1994 | Keshavan et al. |
| 5,589,268 | A | 12/1996 | Kelley et al. |

(Continued)

OTHER PUBLICATIONS

Miettinen, J., "Thermodynamic description of the Cu-Mn-Ni system at the Cu-Ni side," Laboratory of Metallurgy, Vuorimiehentie 2K, Helsinki University of Technology, FIN-02015 HUT, Finland, pp. 147-152, (2003).

(Continued)

*Primary Examiner* — Michael La Villa
(74) *Attorney, Agent, or Firm* — Matthew W. Gordon, Esq.

(57) ABSTRACT

Composite materials comprising a hard ceramic phase and an infiltration alloy are disclosed. The hard ceramic phase may comprise a carbide such as tungsten carbide and/or cast carbide. The infiltration alloy is Cu-based and comprises Ni and Sn. The infiltration alloy may further include Nb, and may be substantially free of Mn. The composite material may be heat treated in order to improve its mechanical properties. For example, the composition of the Cu—Ni—Sn infiltration alloy may be selected such that its hardness, wear resistance, toughness and/or transverse rupture strength are improved after the composite material is solutioned and aged at elevated temperatures.

4 Claims, 3 Drawing Sheets

U.S. PATENT DOCUMENTS

| | | | | |
|---|---|---|---|---|
| 5,733,649 | A | 3/1998 | Kelley et al. | |
| 5,733,664 | A | 3/1998 | Kelley et al. | |
| 5,976,205 | A | 11/1999 | Andrews et al. | |
| 6,811,623 | B2 | 11/2004 | Boegel et al. | |
| 2002/0007879 | A1* | 1/2002 | Nielsen, Jr. et al. | 148/433 |
| 2002/0096306 | A1 | 7/2002 | Butcher et al. | |
| 2003/0007884 | A1 | 1/2003 | Boegel et al. | |
| 2004/0234821 | A1* | 11/2004 | Majagi | 428/698 |

OTHER PUBLICATIONS

Rondot, D. et Mignot, J., "Etude du Stade Initial De La Transformation Structurale de L'Alliage Cu-Ni-Mn 60, 20, 20," Laboratoire de Mecanique Appliquee, Faculte des Sciences, 25030 Besancon Cedex, France, pp. 217-222, (1977).

* cited by examiner

COMPOSITE MATERIALS COMPRISING A HARD CERAMIC PHASE AND A CU-NI-SN ALLOY

FIELD OF THE INVENTION

The present invention relates to composite materials comprising a hard ceramic phase infiltrated with a metal alloy, and more particularly relates to the use of a Cu—Ni—Sn infiltration alloy which is susceptible to heat treatment and demonstrates improved properties.

BACKGROUND INFORMATION

Infiltration alloys are used with hard ceramics such as WC or cast carbides in drilling bit and other cutting tool applications. To make such composite materials, a mold is filled with a mixture of ceramic powder and infiltration alloy powder, heated above the liquidus temperature of the infiltration alloy, and cooled to obtain a composite material. Examples of cutting tools comprising such composite materials are disclosed in U.S. Pat. Nos. 5,589,268, 5,733,649 and 5,733,664 which are incorporated herein by reference.

A conventional infiltration alloy comprises copper, manganese, nickel and tin. When such a Cu—Mn—Ni—Sn alloy is used in composite materials that are brazed to steel shanks of drill bits, a twist-off type of failure tends to occur at the interface between the composite material and the steel shank.

Another conventional infiltration alloy comprises copper, manganese, nickel and zinc. The use of such a Cu—Mn—Ni—Zn infiltration alloy may reduce or eliminate the above-noted twist off failure, but may also cause a drop in erosion resistance.

There is a need for a composite material comprising an infiltration alloy with improved erosion resistance and toughness.

SUMMARY OF THE INVENTION

The present invention provides composite materials comprising a hard ceramic phase and a Cu-based infiltration alloy. The hard ceramic phase may comprise carbides, borides, nitrides and oxides. Suitable carbides include tungsten carbide, tantalum carbide, niobium carbide, molybdenum carbide, chromium carbide, vanadium carbide, zirconium carbide, hafnium carbide, titanium carbide and cast carbides. Borides such as titanium diboride and other refractory metal borides may be used.

The Cu-based infiltration alloy may be a spinodal alloy which comprises Ni and Sn, and may optionally comprise Nb. In one embodiment, the Cu—Ni—Sn infiltration alloy is substantially free of Mn. The composite material may be heat treated in order to improve its mechanical properties. For example, the composition of the infiltration alloy may be selected such that its hardness, wear resistance, toughness and/or transverse rupture strength is improved after the composite material has been solutionized and aged at elevated temperatures. The composite materials are suitable for use in cutting tools and the like.

An aspect of the present invention is to provide a composite material comprising a hard ceramic phase, and a metal phase comprising a heat treated Cu-based infiltration alloy comprising Ni and Sn.

Another aspect of the present invention is to provide a method of making a composite material comprising infiltrating an alloy into hard ceramic particles wherein the infiltration alloy consists essentially of Cu, Ni and Sn.

A further aspect of the present invention is to provide a method of heat treating a composite material comprising providing a composite material including a hard ceramic phase and an infiltration alloy comprising Cu, Ni and Sn, and thermally aging the composite material.

These and other aspects of the present invention will be more apparent from the following description.

DETAILED DESCRIPTION

A composite material comprising a hard ceramic phase and a Cu-based infiltration alloy is provided. In accordance with an embodiment of the present invention, the infiltration alloy is a spinodal Cu—Ni—Sn alloy. Such a spinodal Cu—Ni—Sn alloy may optionally contain Nb, and may be substantially free of Mn. The infiltration alloy may also be substantially free of Zn. The Cu—Ni—Sn alloy is heat treated to improve the properties of the composite material.

Figure 1:
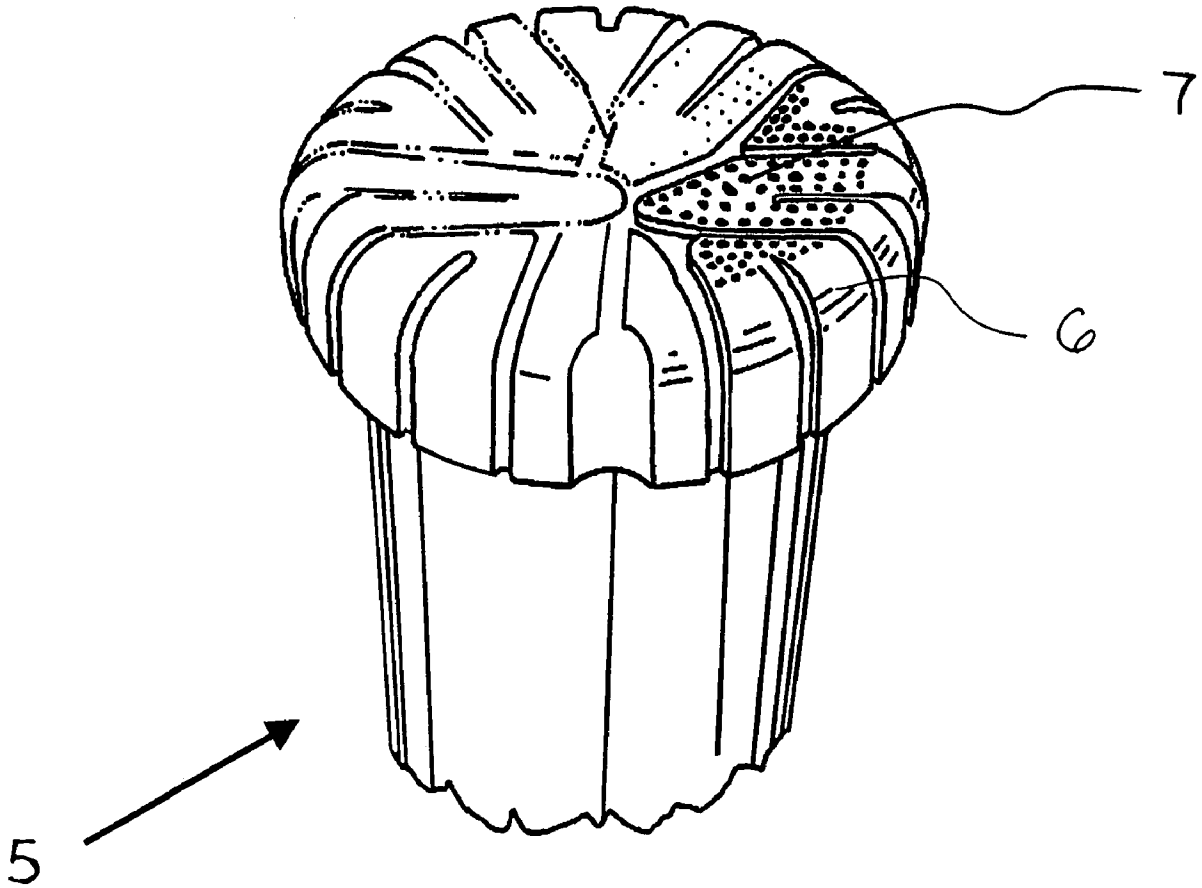
FIG. 1 is an isometric view of a cutting bit including a composite material of the present invention.

FIG. 1. is an isometric view of a cutting bit 5 including a cutting head 6 made of a composite material of the present invention comprising a hard ceramic phase and a heat treated Cu—Ni—Sn infiltration alloy. Discrete diamond elements 7 may be bonded at the forward surface of the cutting head 6.

Suitable hard ceramic materials for use in the composite materials of the present invention include carbides, borides, nitrides and oxides. Suitable carbides for use as the hard ceramic phase include tungsten carbide, tantalum carbide, niobium carbide, molybdenum carbide, chromium carbide, vanadium carbide, zirconium carbide, hafnium carbide, titanium carbide and cast carbides. Suitable borides include titanium diboride and other refractory metal borides. Tungsten carbide may be particularly suitable as the hard ceramic phase.

In accordance with an embodiment of the present invention, the infiltration alloy is a spinodal Cu—Ni—Sn alloy that has been subjected to thermal aging. As used herein, the term "spinodal" means a microstructure formed when an alloy having a miscibility gap is homogenized or solutionized above the miscibility gap and then cooled to a temperature within or below the miscibility gap, followed by thermal aging which forms constituents having different compositions with different lattice parameters that provide strain hardening. The resultant thermally aged spinodal microstructure exhibits at least one improved mechanical property such as increased hardness, wear resistance, toughness and/or transverse rupture strength. In comparison with precipitation strengthened alloys, the improved mechanical properties achieved by heat treating composites comprising the present spinodal infiltration alloys are a result of strain hardening caused by the very fine regions of identical crystal structure but different lattice parameters. The fineness of the spinodal structures is characterized by the distance between regions of different latice parameters, which is on the order of from about 50 to about 1,000 Angstroms.

The amount of copper contained in the Cu—Ni—Sn infiltration alloy typically ranges from about 60 to about 90 percent, for example, from about 80 to about 85 weight percent. As a particular example, the amount of copper may be about 82 weight percent.

The amount of Ni contained in the infiltration alloy typically ranges from about 5 to about 25 weight percent, for example, from about 8 to about 12 weight percent. As a particular example, the Ni content may be about 10 weight percent.

The amount of Sn contained in the infiltration alloy typically ranges from about 4 to about 20 weight percent, for example, from about 5 to about 12 weight percent. As a particular example, the Sn may comprise about 8 weight percent of the infiltration alloy.

In accordance with an embodiment of the present invention, the infiltration alloy may additionally contain Nb. The amount of Nb contained in the infiltration alloy is typically from 0 to about 5 weight percent, for example, from about 0.1 to about 1 weight percent. As a particular example, the amount of Nb may be about 0.2 weight percent.

In an embodiment of the present invention, the infiltration alloy is substantially free of Mn. As used herein, the term "substantially free" means that an element such as Mn is not purposefully added as an alloying addition to the infiltration alloy, and is only present in the infiltration alloy up to trace amounts or as an impurity.

The relative amounts of the hard ceramic powder and infiltration alloy powder may be selected in order to produce the desired ratio of ceramic phase and infiltration alloy phase in the final composite material. The hard ceramic phase is typically the most predominant phase of the composite material on a weight percentage basis. In one embodiment, the hard ceramic phase may comprise from about 60 to about 80 weight percent of the composite material, while the infiltration alloy may comprise from about 20 to about 40 weight percent of the composite. As a particular example, the hard ceramic phase may comprise about 67 weight percent of the composite and the infiltration alloy may comprise about 33 weight percent of the composite.

In addition to the above-noted hard ceramic and infiltration alloy phases, the composite material may optionally include at least one additional phase. For example, the additional phase may comprise iron, 4600 steel, tungsten, cobalt, nickel, manganese, silicon, molybdenum, copper, zinc, chromium, boron, carbon, complex carbide eta phase materials, nitrides and/or carbonitrides. Eta phase materials are of the formula $M_6C$ or $M_{12}C$ where M is a combination of carbide-forming metals such as Co, Fe, Ni and W, e.g., $Co_3W_3C$. Such optional additional phases may be present in the infiltration alloy in a total amount of up to about 5 weight percent.

Figure 2:
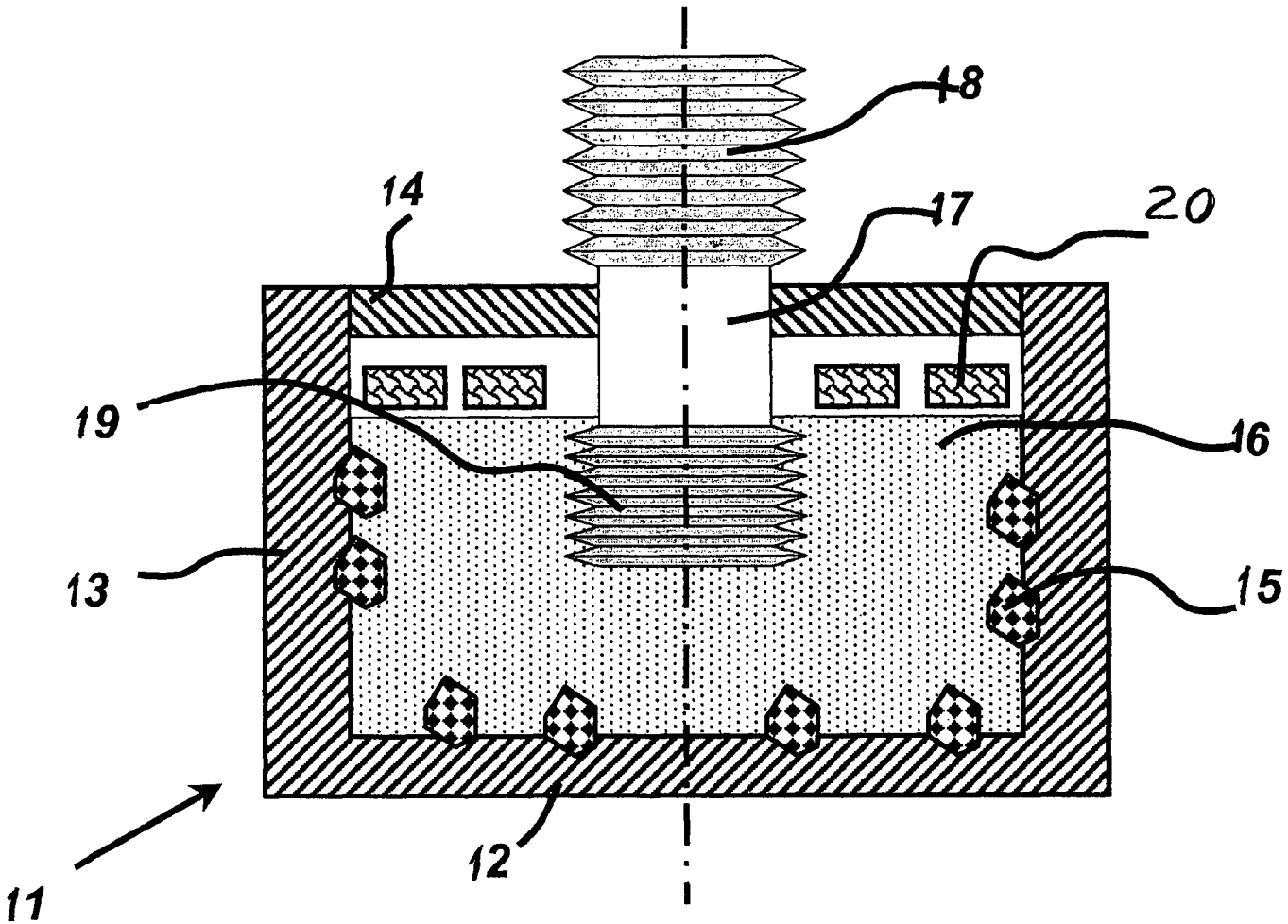
FIG. 2 schematically illustrates a fixture for consolidating composite materials in accordance with an embodiment of the present invention.

FIG. 2 schematically illustrates a fixture for consolidating composite materials of the present invention. The production assembly shown in FIG. 2 includes a carbon mold, generally designated as 11, having a bottom wall 12 and an upstanding wall 13. The mold 11 defines a volume therein. The assembly further includes a top member 14, which fits over the opening of the mold 11. It should be understood that the use of the top number 14 is optional depending upon the degree of atmosphereic control one desires.

A steel shank 17 is positioned within the mold before the powder is poured therein. A portion of the steel shank 17 is within the powder mixture 16 and another portion of the steel shank 17 is outside of the mixture 16. Shank 17 has threads 18 at one end thereof, and grooves 19 at the other end thereof.

Referring to the contents of the mold, a plurality of discrete diamonds 15 are positioned at selected positions within the mold so as to be at selected positions on the surface of the finished product. The ceramic matrix powder 16 is a carbide-based powder, which is poured into the mold 11 so as to be on top of the diamonds 15. Once the diamonds 15 have been set and the ceramic matrix powder 16 poured into the mold, a Cu—Ni—Sn infiltration alloy 20 of the present invention is positioned on top of the powder mixture 16 in the mold 11. Then the top 14 is positioned over the mold, and the mold is placed into a furnace and heated to approximately 1,200° C. so that the infiltration alloy 20 melts and infiltrates the powder mass. The result is an end product wherein the infiltration alloy bonds the ceramic powder together, the matrix holds the diamonds therein, and the composite is bonded to the steel shank.

Figure 3:
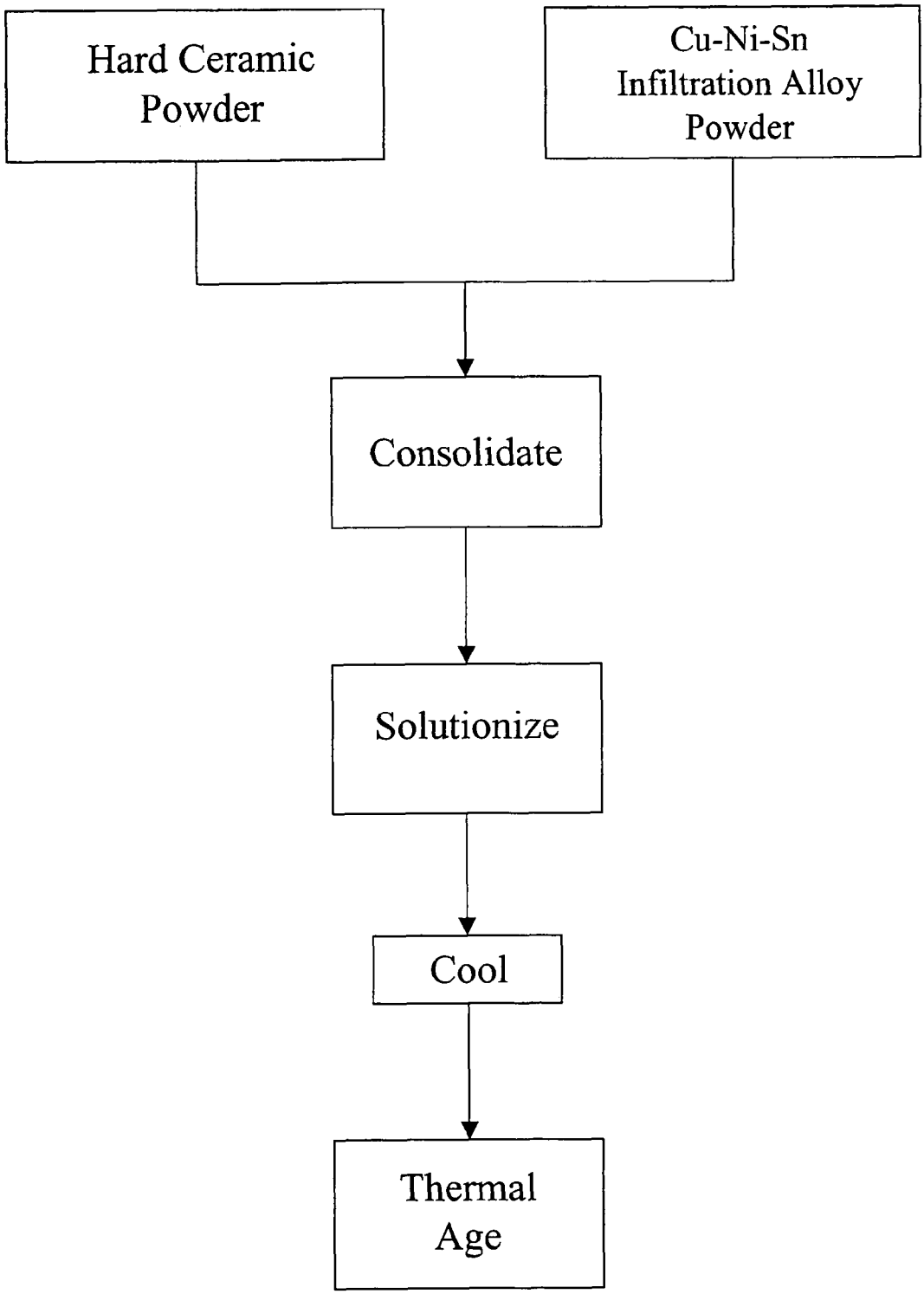
FIG. 3 is a flow diagram illustrating a method of forming and heat treating a composite material comprising a hard ceramic phase and an infiltration alloy in accordance with an embodiment of the present invention.

FIG. 3 schematically illustrates a method of forming and heat treating a composite material comprising a hard ceramic phase and an infiltration alloy in accordance with an embodiment of the present invention. Hard ceramic powder is mixed with Cu—Ni—Sn infiltration alloy powder and consolidated. Consolidation may be performed in a mold by heating the powder mixture above the liquidous temperature of the infiltration alloy. During the consolidation step, temperatures of from about 1,170 to about 1,210° C. are typically used, for example, a consolidation temperature of about 1,200° C. may be suitable. The consolidation temperature is held for a sufficient period of time to allow melting of the infiltration alloy powder and bonding of the hard ceramic powder, such that a dense composite material is formed. The consolidation temperature may typically be held for a duration of from less than 1 minute to more than 5 hours. As a particular example, the consolidation temperature may be held for about 30 minutes.

The consolidated composite material may be cooled, e.g., to room temperature, followed by solutionizing at elevated temperatures, e.g., from about 650 to about 900° C. As a particular example, the solutionizing temperature may be about 825° C. Solutionizing at such elevated temperatures may typically be performed from 0.5 to 24 hours, for example, about 1.5 hours.

After the solutionizing step, the composite may be cooled to ambient temperature by any suitable means such as air cooling. The solutionized and cooled composite material may then be thermally aged at a temperature and time sufficient to increase at least one mechanical property of the composite. For example, thermal aging temperatures may range from about 100 to about 600° C., typically from about 300 to about 400° C. Typical thermal aging times may be from 0.5 to 24 hours, for example, about 5 hours. After the thermal aging step, the composite may be cooled by any suitable means such as air cooling.

Infiltration alloys listed in Table 1 were prepared. Alloy A is a Cu—Ni—Sn—Nb infiltration alloy in accordance with an embodiment of the present invention. Alloy B is a Cu—Mn—Ni—Zn alloy which is provided for comparison purposes.

TABLE 1

Infiltration Alloy Compositions

| | | Content (wt. %) | | | | | |
|---|---|---|---|---|---|---|---|
| Alloy | Description | Cu | Mn | Ni | Sn | Zn | Nb |
| A | Spinodal Alloy | 81.8 | 0 | 10 | 8 | 0 | 0.2 |
| B | Cu—Mn—Ni—Zn Alloy | 53 | 24 | 15 | 0 | 8 | 0 |

Alloys in Table 1 were made in the form of roughly ¼ inch shots (Alloy A) or ½ inch cubes (Alloy B). Graphite molds were used to make infiltrated test specimens containing either an alloy or a mixture of 33% alloy and 67% P90 WC matrix powder comprising 67% macrocrystalline WC (−80+325 mesh) and 31% of cast carbide (−325 mesh).

The test specimens were made by heating the filled molds to 1,200° C. under hydrogen, holding at the temperature for 30 minutes, and cooling to room temperature. The specimens were used to determine impact toughness, B611 wear number, and transverse rupture strength (TRS). In the case of the spinodal alloy A, the following heat treatment was used on a number of specimens to assess the effectiveness of this treatment in improving the alloy properties: solutionize at 825° C.; hold for 1.5 or 5 hours; water quench or air cool; age at 350° C. for 5 hours; and air cool. Results of the tests are listed in Table 2.

TABLE 2

Effect of Heat Treatment and Comparison Between Alloy A and Alloy B Infiltrated Carbides

| Alloy | A (as cast) | A (1.5 hr/WQ) | A (5 hr/AC) | B |
|---|---|---|---|---|
| Hardness (HV) (100% Alloy) | 111 | 251 | 602 | 140 |
| Impact Toughness (ft-lb) | 1.96 | 2.51 | 2.8 | 2.6 |
| B611 wear Number | 0.63 | 0.8 | 0.78 | 0.65 |
| TRS (ksi) | 95.5 | 146.9 | 130 | 90 |

In accordance with an embodiment of the present invention, hardness of the spinodal Alloy A may be dramatically increased by heat treatment. In this embodiment, air cooling may be just as effective as water quenching. The TRS of the Alloy A sample was raised after 1.5 hours of solutionizing and aging. The TRS of the Alloy A sample is almost equal after 5 hours of solutionizing and aging.

In accordance with embodiments of the present invention, it is possible to heat treat a spinodal infiltration alloy to surpass both the wear resistance and TRS of conventional Cu-based infiltration alloys. Drilling bits made with the present spinodal infiltration alloys can be readily heat treated to obtain optimum combinations of service properties.

Whereas particular embodiments of this invention have been described above for purposes of illustration, it will be evident to those skilled in the art that numerous variations of the details of the present invention may be made without departing from the invention as defined in the appended claims.

The invention claimed is:

1. A composite material comprising:

from about 60 to about 80 weight percent hard ceramic particles; and from about 20 to about 40 weight percent of a thermally aged Cu-based infiltration alloy comprising Ni, Sn, and Nb contacting the hard ceramic particles, wherein the thermally aged Cu-based infiltration alloy is a spinodal alloy and is substantially free of Mn, the Cu comprises from about 80 to about 85 weight percent of the thermally aged Cu-based infiltration alloy, the Ni comprises from about 8 to about 12 weight percent of the thermally aged Cu-based infiltration alloy, the Sn comprises from about 5 to about 12 weight percent of the thermally aged Cu-based infiltration alloy, and the Nb comprises from about 0.1 to about 1 weight percent of the thermally aged Cu-based infiltration alloy.

2. The composite material of claim 1, wherein the hard ceramic particles comprise at least one carbide selected from the group consisting of tungsten carbide, tantalum carbide, niobium carbide, molybdenum carbide, chromium carbide, vanadium carbide, zirconium carbide, hafnium carbide and titanium carbide.

3. The composite material of claim 2, wherein the carbide comprises WC.

4. The composite material of claim 1, wherein the composite material has been subjected to thermal aging at a temperature of from about 100 to about 600° C. for a time of from about 0.5 to about 24 hours.

* * * * *